US007815518B2

(12) United States Patent
Doyle

(10) Patent No.: US 7,815,518 B2
(45) Date of Patent: Oct. 19, 2010

(54) TRAINING APPARATUS FOR IMPROVING A GOLF SWING

(76) Inventor: Robert S. Doyle, 74 Blue Heron Dr., Toms River, NJ (US) 08753

( * ) Notice: Subject to any disclaimer, the term of this patent is extended or adjusted under 35 U.S.C. 154(b) by 149 days.

(21) Appl. No.: 12/287,659

(22) Filed: Oct. 14, 2008

(65) Prior Publication Data

US 2009/0105006 A1 Apr. 23, 2009

Related U.S. Application Data

(60) Provisional application No. 60/999,944, filed on Oct. 23, 2007.

(51) Int. Cl.
*A63B 69/36* (2006.01)

(52) U.S. Cl. ..... 473/274; 473/266

(58) Field of Classification Search ..... 473/207, 473/208, 219, 227, 266, 274
See application file for complete search history.

(56) References Cited

U.S. PATENT DOCUMENTS

| | | | | | |
|---|---|---|---|---|---|
| 1,209,031 | A * | 12/1916 | Rhind | ..... | 473/274 |
| 1,636,753 | A * | 7/1927 | Olcott | ..... | 473/274 |
| 1,936,143 | A * | 11/1933 | Shea | ..... | 473/208 |
| 2,252,831 | A * | 8/1941 | Botts | ..... | 473/274 |
| 3,104,880 | A * | 9/1963 | Profera | ..... | 473/274 |
| 3,243,186 | A * | 3/1966 | Johnson | ..... | 473/274 |
| 3,325,169 | A * | 6/1967 | MacKniesh | ..... | 473/140 |
| 3,350,102 | A * | 10/1967 | Tiernan, Jr. | ..... | 473/274 |
| 3,408,078 | A * | 10/1968 | Falerni et al. | ..... | 473/208 |
| 3,508,757 | A * | 4/1970 | Rhodes | ..... | 473/274 |
| 3,712,625 | A * | 1/1973 | Taylor | ..... | 473/274 |
| 4,302,014 | A * | 11/1981 | Shull | ..... | 473/274 |
| 4,513,972 | A * | 4/1985 | Empie | ..... | 473/274 |
| 5,577,729 | A * | 11/1996 | Sabour | ..... | 473/274 |
| 7,204,766 | B1 * | 4/2007 | Rose et al. | ..... | 473/274 |
| 7,568,979 | B2 * | 8/2009 | Arnold, Jr. | ..... | 473/258 |
| 7,572,192 | B1 * | 8/2009 | Boyd | ..... | 473/274 |
| 2009/0105006 | A1 * | 4/2009 | Doyle | ..... | 473/274 |
| 2009/0118026 | A1 * | 5/2009 | Arnold, Jr. | ..... | 473/211 |

* cited by examiner

*Primary Examiner*—Raleigh W. Chiu
(74) *Attorney, Agent, or Firm*—Clifford G. Frayne

(57) ABSTRACT

In the basic embodiment, the golf training device is a support rod, a first end of which is secured to a hinged mechanism, the hinged mechanism being secured to a support, the opposing end of the support rod having secured thereto a head piece or helmet which is engageable with the upper portion of the head or skull of an individual, the support rod extending a sufficient distance from its support and hinge mechanism to allow an individual to execute a golf swing while the head piece is positioned on the golfer's head.

11 Claims, 6 Drawing Sheets

TRAINING APPARATUS FOR IMPROVING A GOLF SWING

RELATED APPLICATIONS

Applicant claims the benefit of provisional application Ser. No. 60/999,944, filed Oct. 23, 2007.

BACKGROUND OF THE INVENTION

1. Field of the Invention

The present invention relates to the sport of golf, and more particularly, to a swing training apparatus which alerts the golfer to head movement during the course of a golf swing, and teaches the golfer muscle memory in order to keep the head stationary, fixed, and in a downwardly angled orientation during the golf swing.

2. Description of the Prior Art

A myriad of factors come into play in order to permit a golfer to strike a golf ball and achieve the desired trajectory and shot result. One of the most important factors in achieving a well struck golf shot is the positioning and movement of the head of a golfer. The head provides the center of balance for the body and the axis about which the body pivots to generate the desired club head speed and it is therefore important that a golfer keep his head in a relatively stationary, fixed positioned during the swing in order to properly strike the ball and achieve the intended trajectory or flight path. The position of the golfer's head is also influenced by a number of independent factors which affect its orientation. These include but are not limited to: 1) the evenness or unevenness of the surface upon which the golfer is standing affects the positioning of the head relative to the golf ball and the swing, 2) as does the stance of the golfer, 3) the angle between the golfer's calf and thigh, 4) the angle or slope of the spine at address, and 5) the hip and shoulder movement during the backswing, downswing, and follow through.

When practicing, the golfer may believe that he is maintaining his head in a stationary, fixed position during the golf swing, or the golfer may rely upon an observer to provide verbal feedback as to the motion of the golfer's head during the golf swing. However, neither of these two practice methods provides any direct tactile feedback to the golfer regarding the motion of his head during the swing. The head may remain fixed in a horizontal plane, but move laterally or vertically. U.S. Pat. No. 7,204,766 to Rose attempted to address this problem, but does not provide the feedback required. One notable golf instructor provided tactile feedback to his students by holding on to their head as they execute the golf swing. Applicant's apparatus achieves the tactile feedback required without the need or presence of an instructor or an assistant. There therefore has been a need for a training device which provides this tactile sensation and feedback to the golfer regarding the motion of his head during the golf swing.

OBJECTS OF THE INVENTION

An object of the present invention is to provide for a novel golf training apparatus which maintains the golfer's head in the same relative position through all phases of the swing from the waggle, to the take away, the backswing, the downswing, impact, and the follow through.

Another object of the present invention is to provide advice that allows the golfer to receive tactile sensation and feedback of the position of his or her head during the swing, and teaches the golfer to maintain the head in a fixed or stationary position with minimal lateral, left or right, front or back, upward or downward movement while performing his or her natural swing.

A still further object of the present invention is to provide for a novel training device for a golfer to gain muscle memory of a proper swing with a stationary head through repeated swings with or without hitting a golf ball, and the relationship of a stationary head to the angle of the spine and the stance through set up and the swing.

SUMMARY OF THE INVENTION

In the basic embodiment, the golf training device is a support rod, a first end of which is secured to a hinged mechanism, the hinged mechanism being secured to a support, the opposing end of the support rod having secured thereto a head piece or helmet which is engageable with the upper portion of the head or skull of an individual, the support rod extending a sufficient distance from its support and hinge mechanism to allow an individual to execute a golf swing while the head piece is positioned on the golfer's head. In the preferred embodiment the golf training device for teaching a golfer to maintain the head in a stationary position during all aspects of the golf swing, the golf training device having a frame, the frame having two legs, each leg having a horizontal portion for contact with a support surface and an upright portion forming an acute angle with the horizontal portion, the two upright legs joined by an upper horizontal cross bar at their upper terminus, and intermediate support cross member positioned midway between the horizontal legs and upper horizontal cross bar, the upper horizontal cross bar having positioned thereon a selectively rotatable T-joint, the outwardly extending leg of the T-joint secured to a head piece support arm extended outwardly from the upper horizontal cross bar, and having secured to the end thereof, a head piece for selective engagement with the upper portion of the head or skull of the individual when swinging a golf club.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 2:
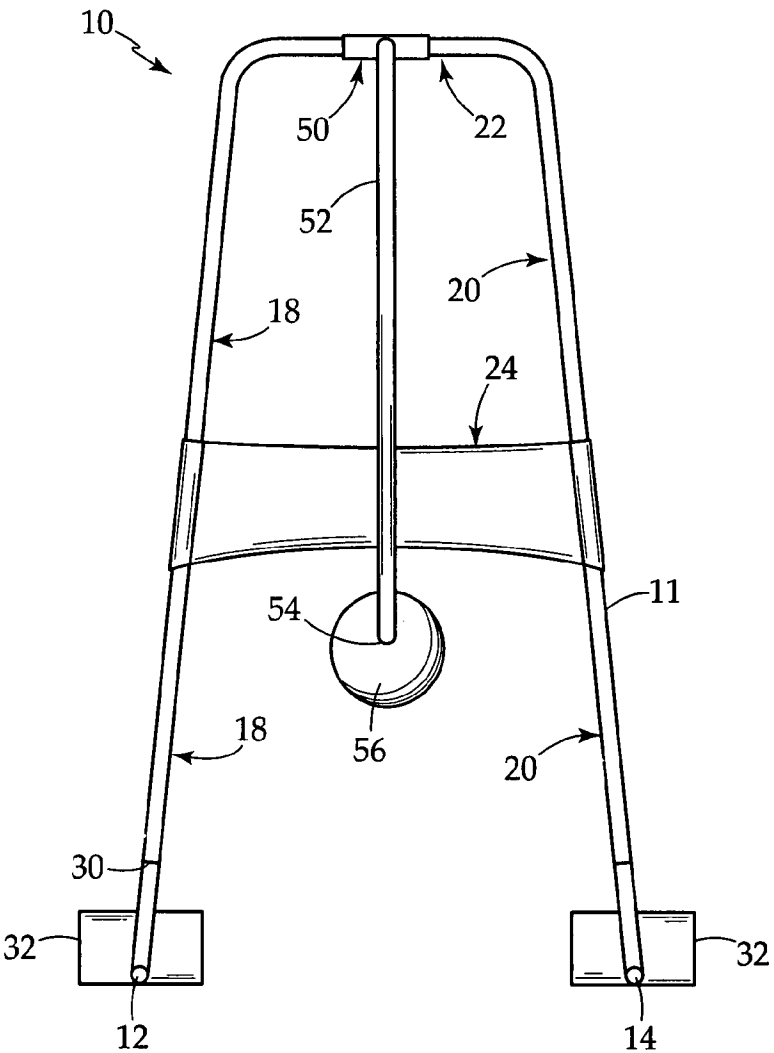
FIG. 2 is a front view of the first embodiment of the training apparatus of the present invention.
Figure 1:
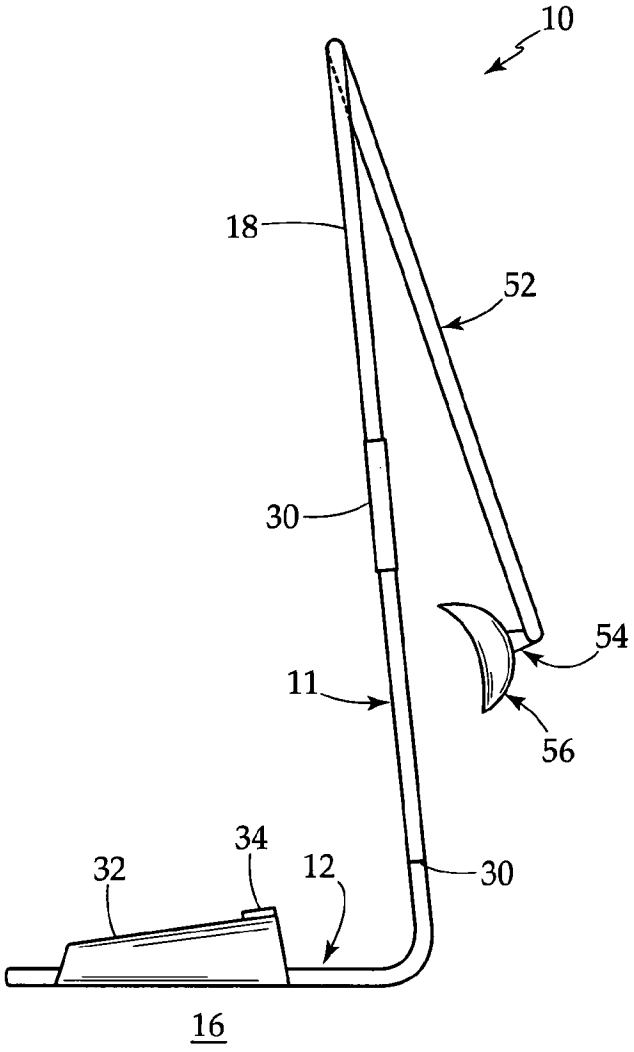
FIG. 1 is a side view of a first embodiment of the golf training apparatus of the present invention.

FIG. 1 is a side view of a first embodiment of the frame of the golf swing training apparatus 10 of the present invention, and FIG. 2 is a front view of the first embodiment of the golf swing training apparatus of the present invention. The apparatus comprises a tubular frame 11, generally inverted U-shaped in configuration, having two horizontal planar legs 12 and 14 which support the frame and the golf swing training apparatus on a surface 16, preferably sod, or on a surface adjacent to a driving range mat or floor. Upstanding legs 18 and 20 extend upwardly at an acute angle θ (between 70° and 85°) with the horizontal planar legs 12 and 14 and are joined at their upper terminus by an upper horizontal cross bar 22. The upstanding legs 18 and 20 while forming an acute angle θ with the horizontal planar legs 12 and 14, are also slightly convergent from horizontal planar leg to upper horizontal cross bar 22.

For stability, there may be one or more cross bars 24 extending between the upstanding legs in the area between the horizontal legs and the upper terminus cross bar. The golf swing training frame as illustrated in FIGS. 1 and 2 can be fabricated from one continuous piece of tubular material which is bent into the configuration as shown in FIG. 1, or the frame can be constructed of modular tubular components 30 as illustrated in FIG. 2 which slide together and interlock in a fashion well known to the trade.

Additionally, for greater stability, there may be secured on to horizontal planar legs 12 and 14, a weight receptacle 32 having a sealable opening 34 which would allow for the introduction of water, sand or another dense fluid or particulate matter to provide weight and stabilization to the frame 11 on a surface 16 upon which it rests.

Figure 4:
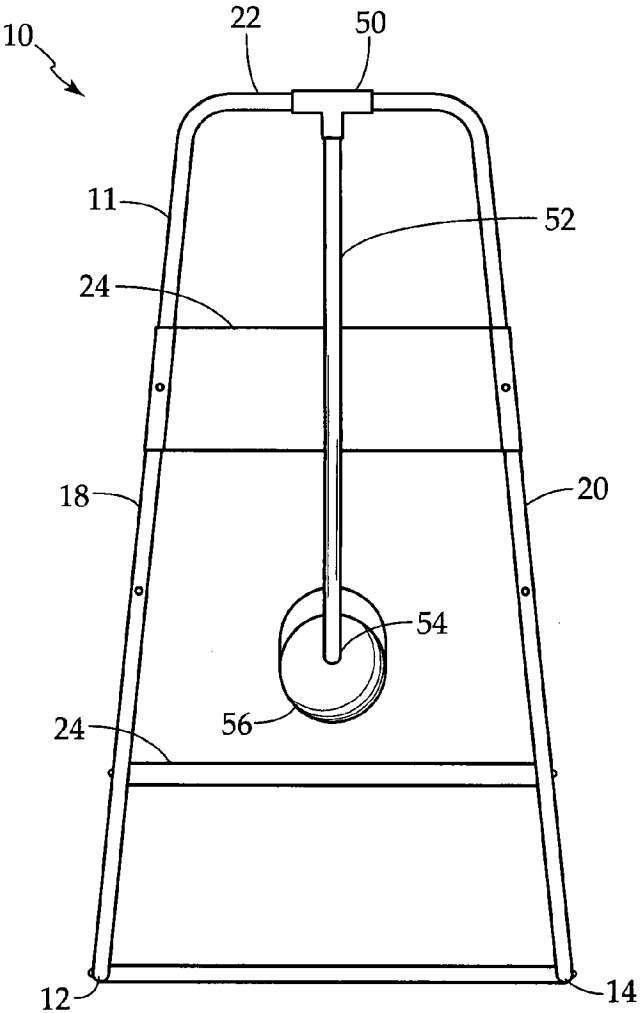
FIG. 4 is a front view of the second embodiment of the training apparatus of the present invention.
Figure 3:
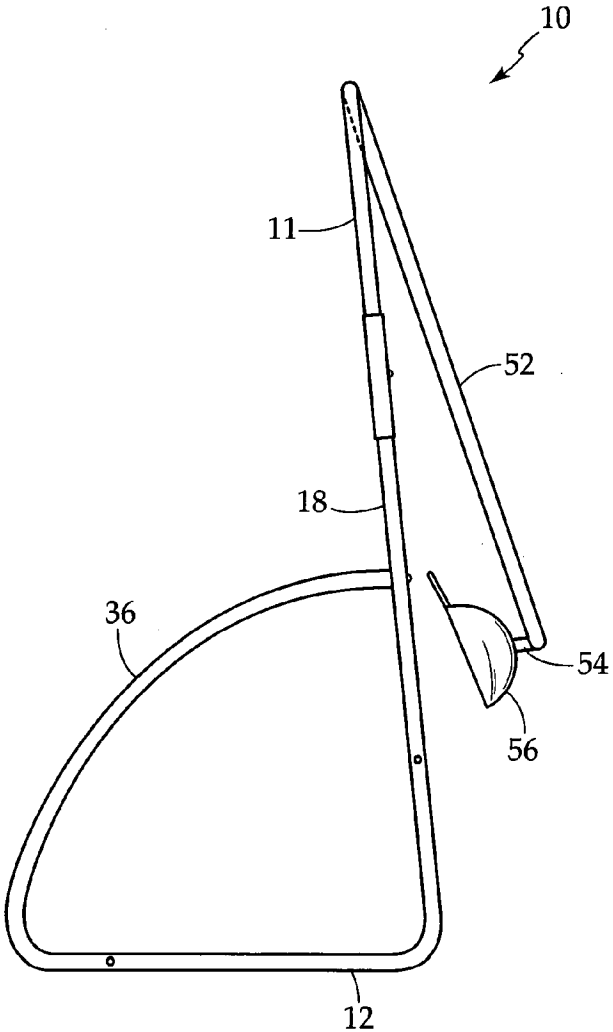
FIG. 3 is a side view of a second embodiment of the golf training apparatus of the present invention.

FIGS. 3 and 4 are illustrative of a second embodiment of the frame 11. It still consists of two horizontal legs 12 and 14 which rest on a support surface 16 similar to the surface identified with respect to FIGS. 1 and 2. The inverted U-shaped portion of the frame consists of two upstanding legs 18 and 20 forming an acute angle θ with the horizontal legs 12 and 14, the upstanding legs terminating in an upper horizontal cross bar 22, the upstanding legs being slightly convergent upon one another from the horizontal legs 12 and 14 to the upper horizontal cross bar 22. In the embodiment illustrated in FIGS. 3 and 4, the horizontal legs 12 and 14 at the ends opposite the acute angle with the upstanding legs, become arcuate 36 and 38 and bend around and are secured to the upstanding legs at a point proximate midway between the horizontal legs 12 and 14 and the upper horizontal cross bar 22. In the embodiment illustrated in FIGS. 3 and 4, there may be additional stabilizing cross bars 24 between the upstanding legs and also between the horizontal legs to provide stability and a degree of rigidity to the frame.

Either frame as disclosed in FIGS. 1 and 2 or in FIGS. 3 and 4 is suitable for mounting the remaining structural elements of the golf swing training apparatus which interacts with the golfer when actually practicing his swing.

In either embodiment, the acute angle between horizontal legs 12 and 14 and upstanding legs 18 and 20 results in a smaller footprint for the golf swing training apparatus 10 on the surface 16 upon which it rests. The acute angle θ also contributes to the stability of the golf swing training apparatus 10 in that a substantial portion of the weight is centered over the horizontal planar legs 12 and 14.

The structure further comprises an adjustable swivel T-joint 50 rotatably mounted on the upper horizontal cross bar 24 of either embodiment. The swivel T-joint 50 has secured to its free leg, a tubular arm member 52, the opposing end of the tubular arm member 52 secured to a connector 54 which in turn is secured to a helmet or head piece 56, which helmet or head piece 56 encapsulates the upper portion of the individual's head or skull in a fashion similar to a cap or hat providing tactile sensation about the head and on top of the head.

Figure 5:
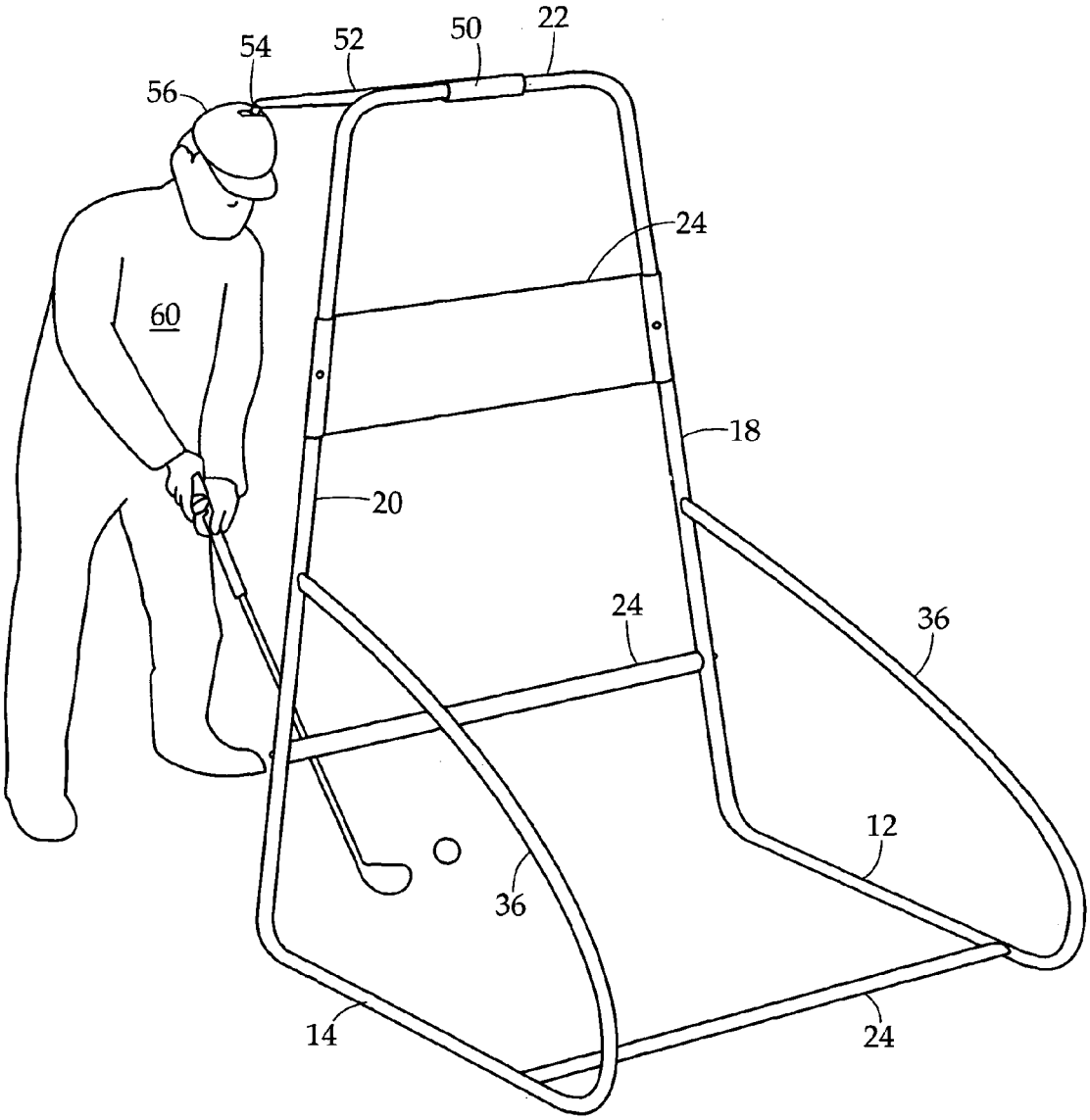
FIG. 5 is a perspective view of the training apparatus of the present invention illustrated with a golfer.

The T-shaped swivel 50 mounted on the horizontal upper cross bar 22 of the frame 11 allows for the adjustment of the height of the helmet or head piece 56 while the connector 54 secured to the opposing end of tubular arm member 52 and to the helmet or head piece 56 allows for adjustment to the head of the individual. FIGS. 1, 2, 3, and 4 illustrate the swivel T-joint and arm and head piece as secured to the frame. FIG. 5 is a perspective view of one embodiment of the training apparatus 10 illustrated with a golfer 60 in position for executing a practice swing.

Figure 6:
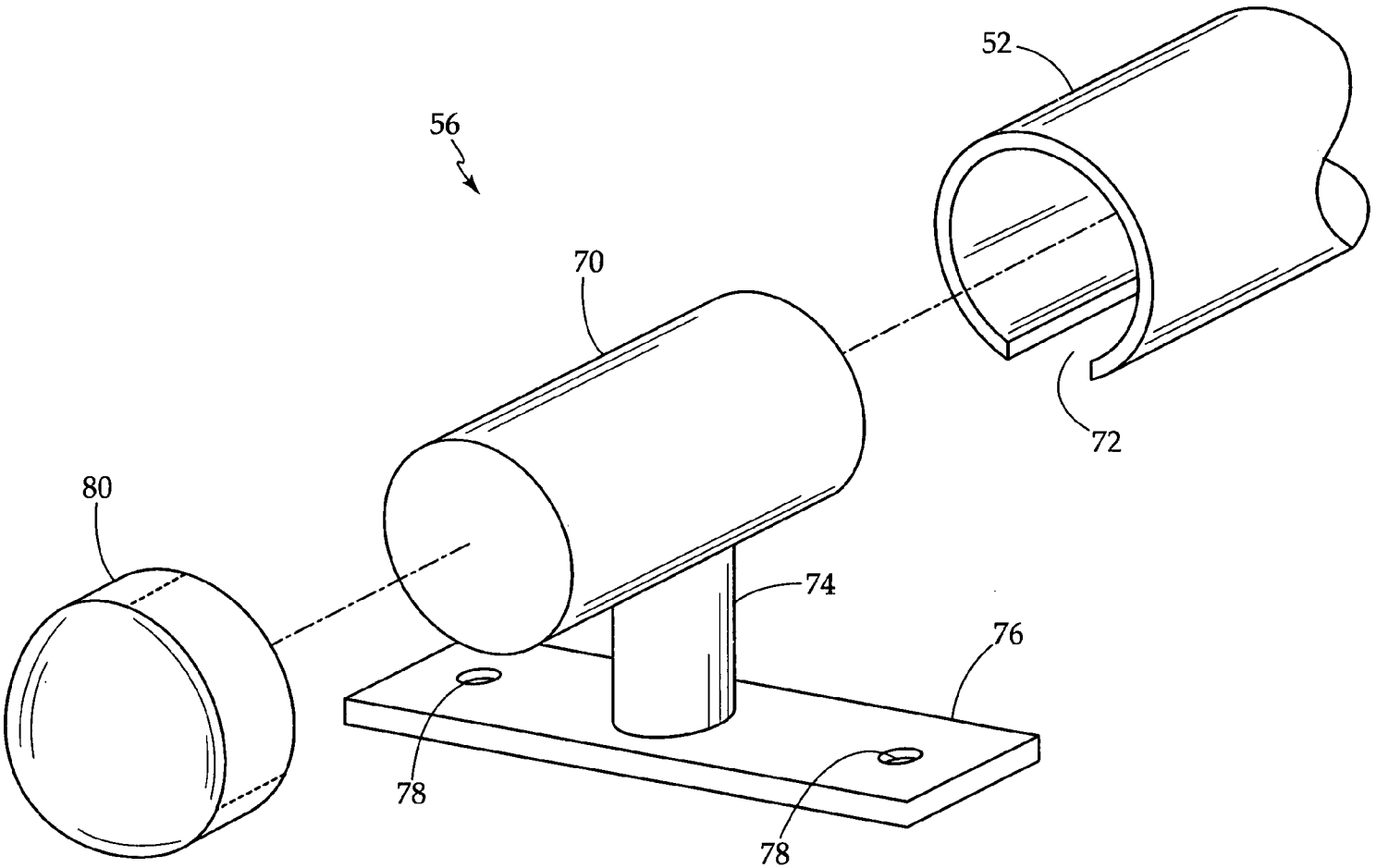
FIG. 6 is a close-up perspective view of the helmet or head piece and its mounting method.
Figure 7:
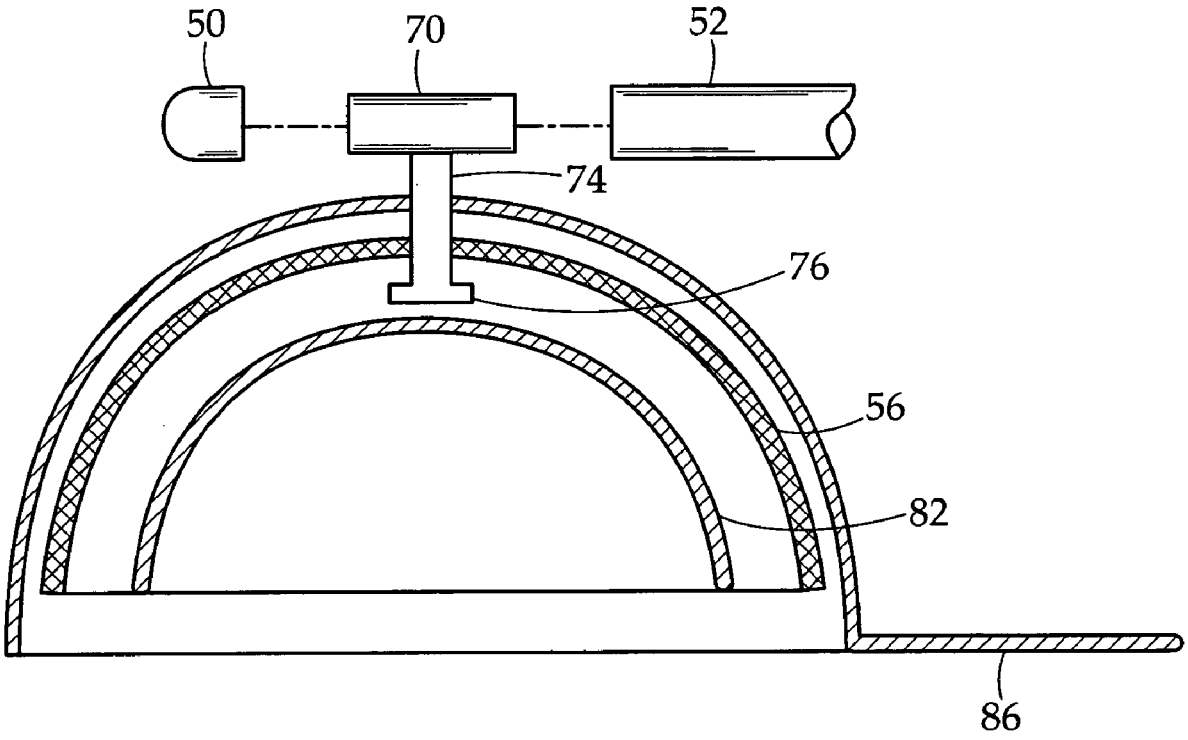
FIG. 7 is a cross section of the helmet or headpiece.

FIG. 6 is a close-up perspective exploded view of the connector mount which secures to the helmet or head piece, and FIG. 7 is a cross-sectional view of the helmet or head piece with the swivel mount with the helmet or head piece incorporating a golfer's cap.

The connector 54 is a generally horizontal cylindrical member 70, having a diameter proximating the inner diameter of tubular arm 52 and is slidably receivable therein by means of slot 72. Connector 70 has a downwardly depending flexible shaft 74, which is slidably receivable into slot 72, shaft 74 terminating in a flexible base plate 76 having a plurality of apertures 78 for securing it to the helmet or head piece 56. An end cap 80 secures connector 54 in its position and orientation with tubular arm member 52. The base plate 76 is secured to the helmet or head piece member 56 by a series of fasteners. Base plate 76 can be secured either to the upper surface of the helmet or head piece 56 or to the lower surface with vertical shaft 74 extending there through. Vertical shaft 74 and base plate 76 are resiliently flexible so as to permit adjustment of the head piece to the head in a manner similar to the adjustment of a hat. The helmet or head piece would preferably be fabricated from plastic and could include a foam cushion liner 82 about its interior surface. The helmet or head piece 56 is designed to provide tactile sensation to the golfer's head, forehead, temples, and rear portion, such that the golfer will receive tactile feedback if his head moves in an inappropriate manner during the golf swing.

For aesthetic purposes, the helmet or head piece as illustrated in FIG. 7 can also be incorporated with a golfer's cap 86, which would be fitted internally with the helmet or head piece 56 secured to connector 54, the connector 54 extending upwardly through an aperture in the cap and being secured within tubular arm member 52 and secured by end cap 80. In this configuration, the golfer gets immediate tactile feedback regarding the position or motion of his head during the golf swing as the head will encounter resistance from the helmet or head piece 56 if it moves in a horizontal plane. Similarly, the golfer will receive tactile resistance if his head moves upwardly as a result of his attempting to lessen the flex in his legs. The golfer will lose tactile sensation about the head if the golfer increases the flexion within his legs, such that his head drops down losing tactile sensation with the helmet or head piece.

With the connections illustrated, the tubular arm member 52 and the orientation of frame 11, the golf training apparatus can be adjusted to accommodate golfer's of varying heights, and golfers with various swing characteristics, such as leg flexion, arm length, and the like.

Figure 8:
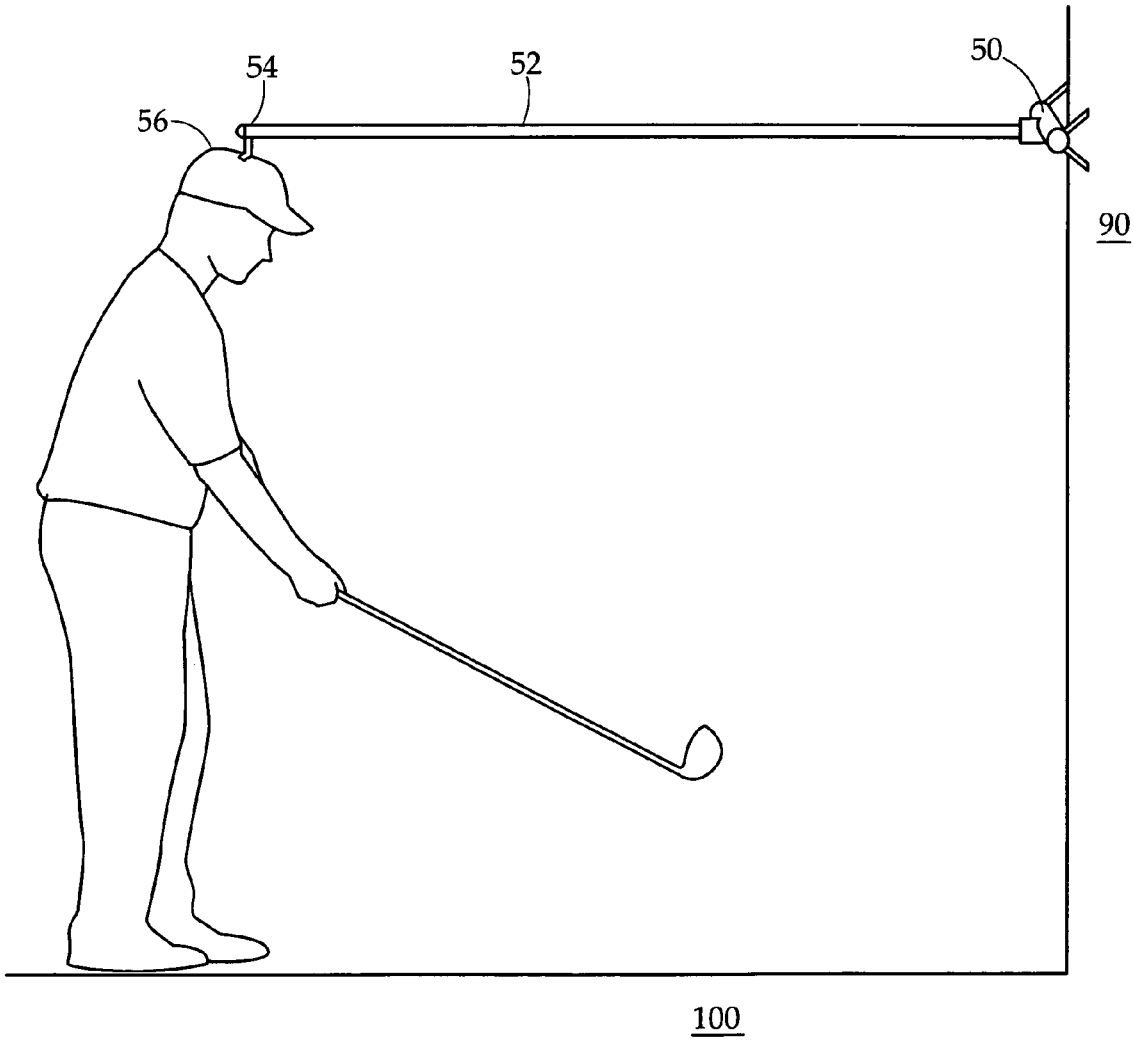
FIG. 8 is a perspective view of the training apparatus secured to a stationary object.

In a third embodiment of the training apparatus, illustrating in a perspective view in FIG. 8, the frame portion of the golf swing training apparatus is eliminated. A stationary object such as a wall or pole 90 in the ground 100, or any other structural element that could support a hinge 50 secured thereto, the hinge receiving one end of a support arm 52 identical to that illustrated with respect to embodiments 1 and 2 and having a head piece or a helmet 56 secured at the opposing end thereof. This embodiment would be a more permanent installation in that the vertically swivable hinge 50 would be secured to the structural element by threaded fasteners or the like at a height desired by the user to accommodate the user's stance when swinging a golf club. However, due to the design of the golf training device, the vertical swivel adjustment provided by the hinge and the head piece or helmet secured to the opposing end based upon the length of the support arm, would allow golfers of varying heights and varying swing stances to use the golf swing training device without the need for repositioning the hinge.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A golf training apparatus for providing tactile feedback to a golfer in detecting movement of the head of a golfer while a golfer executes a golf swing, the training apparatus comprising:

a support frame including a pair of horizontal base supports in spaced apart parallel relationship, each base support having a first end and a second end, said first ends secured to upstanding leg supports, said upstanding leg supports forming an acute angle with said base supports, said upstanding leg supports terminating in a cross member extending between said upstanding leg supports, and a swivel hinge mounted to said cross member, said swivel hinge rotatable about said cross member, said swivel hinge having secured thereto a first end of an extended support arm, and a head piece, said head piece comprising a hollow spherical section adapted to fit about the forehead and upper head portion of a golfer, said head piece secured to a second end of said extended support arm allowing said golfer to execute a golf swing.

2. The golf swing apparatus in accordance with claim 1 wherein said swivel hinge is T-shaped and said extended support arm is adjustable in a vertical plane to accommodate golfers of varying heights.

3. The golf training apparatus in accordance with claim 1 wherein said head piece allows said golfer's head to rotate laterally when making a golf swing.

4. The golf training apparatus in accordance with claim 1 wherein said acute angle formed between said upstanding supports and said horizontal base supports is between 70° and 85°.

5. The golf training apparatus in accordance with claim 1 wherein said second end of said base supports extend arcuately upward from said underlying support and are secured to said respective upstanding legs.

6. The golf training apparatus in accordance with claim 5 wherein said base support legs are formed with receptacles for receipt of stabilizing weight.

7. The golf training apparatus in accordance with claim 1 wherein said head piece is positioned within a golf cap.

8. The golf training apparatus in accordance with claim 1 wherein said head piece is secured to said extended support arm by a resilient, flexible connector secured within said extended support arm, said connector having a flexible, resilient depending arm securing a flexible, resilient base member having a plurality of apertures for securing said connector to said head piece.

9. A golf training apparatus for providing tactile feedback to a golfer in detecting movement of the head of the golfer while the golfer executes a golf swing with a golf club, the training apparatus comprising:

a support arm having a first end and a second end, said first end of said support arm secured to a hinge member, said hinge member secured to a support, said hinge member permitting said support arm to angularly rotate in a vertical plane, said second end of said support arm having a head piece secured thereto, said head piece comprising a hollow spherical section adapted to fit about the forehead and upper head portion of a golfer, and providing tactile feedback to the golfer regarding head movement during the execution of a golf swing, said head piece is secured to said extended support arm by a resilient, flexible connector secured within said extended support arm, said connector having a flexible, resilient depending arm securing a flexible, resilient base member having a plurality of apertures for securing said connector to said head piece.

10. The golf training apparatus in accordance with claim 9 wherein said head piece allows said golfer's head to rotate laterally when making a golf swing.

11. The golf training apparatus in accordance with claim 9 wherein said head piece is positioned within a golf cap.

* * * * *